US012433464B2

(12) United States Patent
Wiltshire

(10) Patent No.: US 12,433,464 B2
(45) Date of Patent: Oct. 7, 2025

(54) FLOOR TREATMENT MACHINE

(71) Applicant: Numatic International Limited, Cambrley (GB)

(72) Inventor: Simon Wiltshire, Chard (GB)

(73) Assignee: Numatic International Limited (GB)

( * ) Notice: Subject to any disclaimer, the term of this patent is extended or adjusted under 35 U.S.C. 154(b) by 403 days.

(21) Appl. No.: 17/633,112

(22) PCT Filed: Aug. 7, 2020

(86) PCT No.: PCT/GB2020/051895
§ 371 (c)(1),
(2) Date: Feb. 4, 2022

(87) PCT Pub. No.: WO2021/028667
PCT Pub. Date: Feb. 18, 2021

(65) Prior Publication Data

US 2022/0330776 A1 Oct. 20, 2022

(30) Foreign Application Priority Data

Aug. 9, 2019 (GB) ..... 1911417

(51) Int. Cl.
*A47L 11/26* (2006.01)
*A47L 11/283* (2006.01)
*A47L 11/40* (2006.01)

(52) U.S. Cl.
CPC ..... *A47L 11/26* (2013.01); *A47L 11/283* (2013.01); *A47L 11/4072* (2013.01); *A47L 11/4075* (2013.01)

(58) Field of Classification Search
CPC ..... A47L 11/4055; A47L 11/305; A47L 11/4058; A47L 11/4075; A47L 11/26; A47L 11/283; A47L 11/4072
See application file for complete search history.

(56) References Cited

U.S. PATENT DOCUMENTS 2,949,619 A 8/1960 Holt
3,013,287 A 12/1961 Raymond
(Continued)

FOREIGN PATENT DOCUMENTS

CN 202288141 U 7/2012
CN 103037747 A 4/2013
(Continued)

OTHER PUBLICATIONS

International Search Report and Written Opinion dated 10/22/20220 for PCT/GB2020/051895.
(Continued)

*Primary Examiner* — Andrew A Horton
(74) *Attorney, Agent, or Firm* — Dorsey & Whitney LLP

(57) ABSTRACT

Walk-behind floor treatment machine comprising: a base portion provided with and supported by at least one rotatable work head for treating the floor, a handle portion for steering or guiding the machine along a working direction of travel and adapted to be pivotable with respect to the base portion, drive means for rotating the work head with respect to the base portion, floor-engaging wheel means for supporting the handle portion, the wheel means having a substantially transverse axis of rotation so as to permit travel in the working direction, the wheel means being coupled to the base portion by a linkage which permits vertical travel of the base portion and associated work head or heads with respect to the wheel means, but which provides transverse constraint to limit or prevent yawing of the base portion with respect to the wheel means, wherein a lower region of the handle portion is pivotably connected to the wheel means so that the handle portion may pivot through a generally vertical arc, and wherein a handle pivot lock mechanism is provided in which the adoption of a predetermined handle portion orientation permits one or more locking feature to act on one
(Continued)

or more corresponding constraint feature so as to prevent pivoting movement of the handle portion with respect to the linkage, whereby tilting back of the locked handle portion causes a corresponding rise of the linkage and base portion with work head so as to lift them from the floor surface, wherein a squeegee suction device is provided for collecting and entraining liquid lifted from a floor surface over which the machine travels, the squeegee suction device being attached to the wheel means via one or more trailing arm which is attached at one end region to the squeegee device and at the opposite end region is pivotably attached to the wheel means for pivoting co-axially about the said transverse axis of rotation, the arrangement being such that the trailing arm and squeegee may pivot up or down about the transverse axis as they trail behind the treatment machine.

24 Claims, 10 Drawing Sheets

(56) References Cited

U.S. PATENT DOCUMENTS

| | | | | |
|---|---|---|---|---|
| 3,939,518 | A * | 2/1976 | Whitney | A47L 11/4055 15/98 |
| 4,483,041 | A * | 11/1984 | Waldhauser | A47L 11/4044 15/98 |
| 5,765,250 | A | 6/1998 | Lee | |
| 9,814,364 | B1 * | 11/2017 | Caruso | A47L 11/4075 |
| 2022/0330776 | A1 | 10/2022 | Wiltshire | |

FOREIGN PATENT DOCUMENTS

| | | | |
|---|---|---|---|
| CN | 104780819 | A | 7/2015 |
| CN | 105078371 | A | 11/2015 |
| CN | 105078372 | A | 11/2015 |
| EP | 2832277 | A2 | 2/2015 |
| GB | 201207985 | | 6/2012 |
| GB | 2501772 | A | 11/2013 |
| KR | 20130032817 | A | 4/2013 |

OTHER PUBLICATIONS

Notice of Allowance dated Nov. 8, 2024 for U.S. Appl. No. 17/633,112.
Office Action dated May 7, 2024 for U.S. Appl. No. 17/633,112.
Great Britain Search Report dated Feb. 7, 2020 for GB1911417.2.

* cited by examiner

FLOOR TREATMENT MACHINE

The present invention relates to the field of floor treatment machines for scrubbing, polishing, sanding or burnishing floors. In these machines one or more driven rotatable work heads (such as scrubbing brushes) are provided for agitating the floor surface. In particular the invention relates to a walk-behind machine provided with a handle for steering and guiding the machine as it travels over a floor surface.

EP2832277 (i-mop GmbH) discloses a walk-behind wet floor scrubber have two side-by-side work heads, each comprising disc-shaped floor brushes. There is a trailing squeegee and associated suction drive and reservoir for collecting liquid from the floor surface. The brushes support the weight of the machine and counter-rotate to provide propulsive force. The suction drive is disposed on a handle portion of the machine, along with a clean water reservoir for feeding a cleaning-liquid dispenser. The hand has dual pivot axes permitting up/down handle movement as well as side-to-side. A problem with these machines is that when not in use the elongate handle should be conveniently secured vertically against movement in the two axes, without having to be leant against another object.

The present invention seeks to provide a handle immobilisation mechanism which is effective for securing floor treatment machine handles against handle pivoting, whether in one axis or two axes.

These aims and others are met by the present invention in its various aspects, as will be evident from the following description.

According to one aspect of the invention there is provided a walk-behind floor treatment machine comprising: a base portion provided with and supported by at least one rotatable work head for treating the floor, a handle portion for steering or guiding the machine along a working direction of travel and adapted to be pivotable with respect to the base portion, drive means for rotating the work head with respect to the base portion, floor-engaging wheel means for supporting the handle portion, the wheel means having a substantially transverse axis of rotation so as to permit travel in the working direction, the wheel means being coupled to the base portion by a linkage which permits vertical travel of the base portion and associated work head or heads with respect to the wheel means, but which provides transverse constraint to limit or prevent yawing of the base portion with respect to the wheel means.

The linkage may preferably be a strut or arm or chassis or frame.

A lower region of the handle portion is pivotably connected to the wheel means so that the handle portion may pivot through a generally vertical arc, and wherein a handle pivot lock mechanism is provided in which the adoption of a predetermined handle portion orientation permits one or more locking feature to act on one or more corresponding constraint feature so as to prevent pivoting movement of the handle portion with respect to the linkage, whereby tilting back of the locked handle portion causes a corresponding rise of the linkage and base portion with work head so as to lift them from the floor surface.

A squeegee suction device is provided for collecting and entraining liquid lifted from a floor surface over which the machine travels, the squeegee suction device being attached to the wheel means via one or more trailing arm which is attached at one end region to the squeegee device and at the opposite end region is pivotably attached to the wheel means for pivoting co-axially about the said transverse axis of rotation, the arrangement being such that the trailing arm and squeegee may pivot up or down about the transverse axis as they trail behind the treatment machine. Each trailing arm is may be pivotally attached to the squeegee device so that the squeegee device is capable of pivoting with respect to the trailing arm about a generally transverse axis of rotation. This ensures that the squeegee can transit over gradients without suction being lost.

In a preferred aspect of the invention a squeegee latch mechanism is provided which is configured to latch the trailing arm in a fixed rotational position with respect to the linkage between the body portion and the wheel means. This position preferably corresponds to a lifted squeegee orientation in which the squeegee device is spaced apart from the floor. Looked at another way, with the squeegee in contact with the floor the front region of the machine is lifted up to the linkage is angled upwards and the work head(s) is raised from the floor.

The latching between trailing arm and latch mechanism preferably involves the engagement of a dog with a corresponding constraint feature. The dog may be provided on the trailing arm. The constraint feature may be provided by a latching member.

Latching may take place when the locked handle portion is tilted down sufficiently to cause the trailing arm to approach the latching member so that the dog engages with a seat which includes the constraint feature. A squeegee release lever may be provided which is adapted to act upon the latching member to release an engagement between the latching member and the dog. The latching member may be pivotally fixed to a rear end region of the linkage. The latching member is preferably spring biased so as to urge the latching member into an engagement disposition in which the dog abuts the constraint feature when sufficient relative motion of the dog and latch has taken place during tilting.

A squeegee release lever may be provided. This may comprise an upper free end region which may be foot or hand operated and a lower region which is attached for coaxial pivoting about the transverse axis of rotation of the wheel means. The lower end region of the lever may be configured with a rising camming surface which acts upon the latching member to disengage the constraint feature from the dog when the lever is depressed. The squeegee device may thereafter revert to a working configuration on the floor surface.

The fixed rotation position adopted by the latched squeegee device preferably corresponds to the locked handle being tilted to at least an amount at which the work head is lifted clear of the floor surface. When the work head is pivotally attached to the linkage, the clearance for the work head in the tilted orientation is preferably sufficient to allow the work head to rotate freely from a working orientation to a maintenance or storage orientation in which the underside of the work head is facing generally outwards for access. Outwards typically means with the working surface (e.g. brush) being oriented on its side. Conveniently, the work head is provided with one or more legs, feet, wheels or rollers for supporting the work head in this maintenance or storage orientation.

There are preferably two transversely spaced apart: trailing arms, latching members, trailing arm dogs, release levers, and linkages between the wheel means and base portion.

A handle pivot lock mechanism may be provided in which the adoption of a predetermined handle portion orientation permits one or more locking feature to act on one or more corresponding constraint feature so as to prevent pivoting movement of the handle portion with respect to the base portion. The predetermined handle orientation is preferably a vertical, or substantially vertical, orientation.

In the predetermined orientation the locking feature preferably becomes aligned with the constraint feature so as to permit mutual engagement. Conversely, when the orientation is not achieved misalignment prevents engagement of the features.

The locking feature or features may be one or more detent feature and the constraint feature or features are one or more indent feature. One of said features may be associated with the base portion or linkage, and the other of said features may be associated with the handle portion.

The pivoting of the handle may (at least) be up/down pivoting about a transverse axis, and the features may act to secure the handle portion against pivoting with respect to the transverse axis.

A user-operable lock-mechanism actuator is preferably provided which must be operated to allow the locking and constraint features to act on each other. This actuator may then be operated to unlock the features so as to release the handle portion.

The wheel means may comprise a wheel, roller or ball, preferably a single wheel, roller or ball, disposed at a lower region of the handle portion. The wheel means preferably has a fixed transverse axis of rotation.

In one aspect the linkage comprises at least one strut, one end region of which is provided with a pitch pivotal connection to the wheel means, which connection is coaxial with the wheel means axis of rotation, and wherein another end region of the strut is attached to the base portion.

The strut may be provided with a convex upper surface provided with the indent feature. The detent feature may be connected to a lower region of the handle portion for travel in an arc which corresponds to the profile of the convex upper surface, the arrangement being such that the detent feature can slide over the convex surface during up/down pivoting of the handle portion about the transverse axis.

A lock actuator may be provided to displace or urge the detent feature against the surface so when the detent feature and indent feature are aligned the detent feature projects into the indent so as to lock motion of the handle portion.

In a preferred arrangement there are two said struts disposed on either side of the wheel means in a generally parallel arrangement and two respective detent features, one for each strut. The two detent features may be provided by respective downwardly extending prongs of a locking member fork.

The convex surface may be provided with end stops at opposite ends thereof, which end stops limit travel of the detent along the convex strut profile so as to limit transverse pivoting of the handle portion to upper and lower arc boundaries.

The other end region of the strut or struts may be attached to the base portion via a pitch pivotal connection. The aforementioned pitch pivotal connections permit the vertical travel of the base portion with respect to the wheel means.

Said one or more rotatable work head typically support the base portion on the floor surface with the linkage permitting floating vertical travel of the work heads with respect to the wheel means.

The articulated joint permits side-to-side pivoting of the handle about the joint about an axis perpendicular to the pivot transverse axis. The side-to-side pivot of the articulated joint is provided at a location vertically/rearwardly spaced apart from the transverse pivot.

A side-to-side pivot locking mechanism is provided in which entry of a traveller associated with the handle portion into a constraint feature prevents side-to-side pivoting. In a preferred aspect the traveller is a retractable shuttle accommodated in a lower end region of the handle portion. The shuttle may be movable from a retracted position in which side to side pivoting of the handle portion is permitted, and an extended position in which a distal end of the shuttle is constrained (e.g. between cheek features) which prevent pivoting from side-to-side of the handle portion.

The cheek features may define a generally vertical enclosure for accommodating the distal end of the shuttle, the shuttle traveling axially with respect to the handle portion, so that when the shuttle distal end is constrained the handle is dead centre of the side-to-side handle movement range.

The traveller/shuttle may be capable of acting on said locking member fork to cause locking of transverse handle portion pivoting as the side-to-side pivoting is locked.

The locking member fork and traveller may be connected by a pin and track engagement which provides vertical pin constraint and limited lateral pin freedom corresponding to side-to-side handle portion pivoting. The track is preferably arcuate in form.

Movement of the traveller towards the constraint condition may cause the pin to act on the track constraint, and wherein the track is provided in the locking member fork, so that movement of the traveller causes movement of the fork into indent engagement.

In this arrangement both handle portion pivot axes may be locked at the same time, conveniently with the handle portion in a generally vertical orientation.

The traveller or shuttle may be resiliently biased so that when actuated the traveller/shuttle is urged towards its constraint position.

A distal end of the handle portion may be provided with a transversely oriented handle bar for the user to grip with a hand on each side of the bar. An upper end region of the handle portion may be provided with a handle position locking mechanism actuator.

The wheel means may comprise a wheel, roller or ball, singular or co-axial adjacent pairs. Preferably there is a single wheel, roller or ball, most conveniently disposed at a lower region of the handle portion. The wheel means may preferably have a fixed transverse axis of rotation (when placed on the floor). In other words there is no caster wheeling. The wheel or roller may however be adapted to tilt into a turn (so it tilts about an axis coaxial with the direction of travel).

The articulated joint may comprise a yoke which accommodates the wheel, roller or ball of the wheel means, which yoke preferably pivots about the wheel rotation axis. The side-to-side pivot may be disposed on an upper bridging portion of the yoke. The side-to-side pivot may comprise a U-section bracket rotated 90 degrees with respect to the yoke and which receives a lower end of the handle, with a pivot pin bridging the bracket cheeks.

The base portion and associated work head(s) may be disposed at a front region of the machine. The wheel means may be disposed aft of the work head(s) and base portion with the linkage coupling extending between the wheel means and base portion (preferably generally centrally of machine or a centre region of the base portion).

In a preferred aspect of the invention, the machine is a wet scrubbing machine. It may be provided with a cleaning fluid reservoir and cleaning fluid delivery outlet.

Forward propulsion of the machine is preferably provided by work head rotation. For transversely mounted rollers the direction of rotation controls forward or backward movement. For the preferred disc-shaped work heads which rotate about a vertical axis, the propulsion can be provided by using two work heads which counter-rotate. For a single such work head, the user can roll the handle slightly to roll the work head lightly which will cause improved traction on one side of the work head, which will induce forward propulsion if that side is the returning rotational side.

The drive means may comprise one or more electric motors carried by the base portion and coupled to the work head or heads. In a preferred arrangement there are two generally disc-shaped work heads disposed side-by-side and oriented to rotate about a respective vertical axis of rotation. There are conveniently two electric motors, each disposed above its associated work head. Other arrangements are possible, such as a single motor which drives both heads via a pulley, chain or gear train. For simplicity a single motor for each head is preferred. The twin motors are configured and/or controlled to cause the work heads to counter rotate with respect to one another, thereby to provide a propulsive force. Scrubber brush driven machines are well known in the art. For example a single brush may be induced to drive by tilting the machine (base portion) onto the retreating side of a rotating disc-shaped, floor facing, work head.

The machine of the invention is preferably a walk-behind machine. To ease handling and guiding a distal end of the handle portion may be provided with a transversely oriented handle bar for the user to grip with a hand on each side of the bar. The handlebar may be provided with a speed control lever and cleaning fluid dispensing actuator.

Following is a description by way of example only and with reference to the accompanying drawings of one mode for putting the present invention into effect.

In the drawings:

FIG. 1 is a three-quarter perspective view from above of a floor scrubber-dryer that is in accordance with the present invention.

FIG. 2 a side view, partially in section, of detail of the floor scrubber dryer of FIG. 1.

Figure 1:
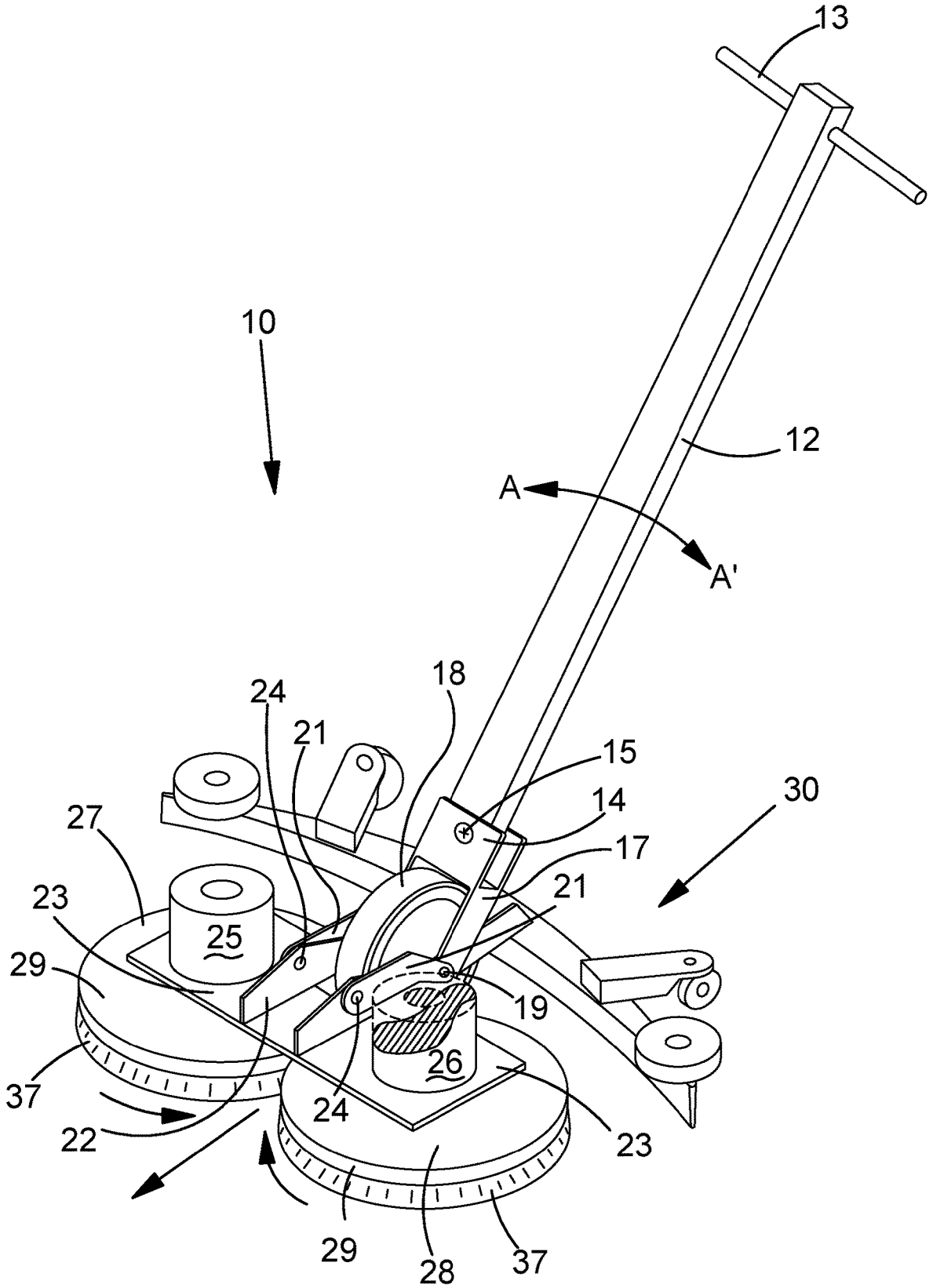

Details of the latching mechanism in accordance with the invention are described in detail later with reference to FIGS. 4 to 10, and are not shown in FIGS. 1 to 3 for the sake of clarity and simplicity. In FIG. 1, a floor scrubber dryer machine in accordance with the present invention is shown generally as 10. The machine comprises an elongate rectangular section handle portion 12. The handle portion 12 comprises a top end region and a bottom end region. A handlebar 13 is transversely mounted via a bore at the top end region of the handle portion 12. A control unit (not shown) is also provided at the top end region. During use the user walks behind the machine and guides it over the floor surface to be cleaned using the handlebar 13.

The bottom end region of the handle portion 12 is pivotally attached between upstanding ear portions of an upstanding, generally U-section mounting bracket 14. The pivot 15 is oriented fore-aft to enable side-to-side rotation of the handle portion relative to the bracket 14 about the pivot, as shown in the arrows A, A'. The axis is substantially perpendicular to the length of the handle portion 12 and permits the handle to be swung transversely from side to side about the bottom end of the handle portion.

The bracket 14 has a lower region which is configured as a fork or yoke 17 formed by two spaced apart downwardly extending cheek plates. A guide wheel 18 is located between the cheek plates and mounted for rotation about an axle (not visible) which is co-axial with the wheel axle 19, best seen in FIG. 2. The wheel has a central hub and a circumferential solid rubber tyre. The axle permits the mounting bracket, fork and handle portion to be pivoted forward/backwards, up/down through an arc around the transverse axis provided by the axle.

In the present embodiment the wheel 18 is arranged to enable rotation about a single axis and is otherwise fixed in position. However, in other embodiments, the wheel 18 may be configured to lean either left or right into a turn as a user manoeuvres the machine 18 around the floor surface. This can improve the handling of the machine 10. The same leaning could apply to other wheel means which may be used, such, as indicated at V in FIG. 2. as a roller or a ball.

Figure 2:
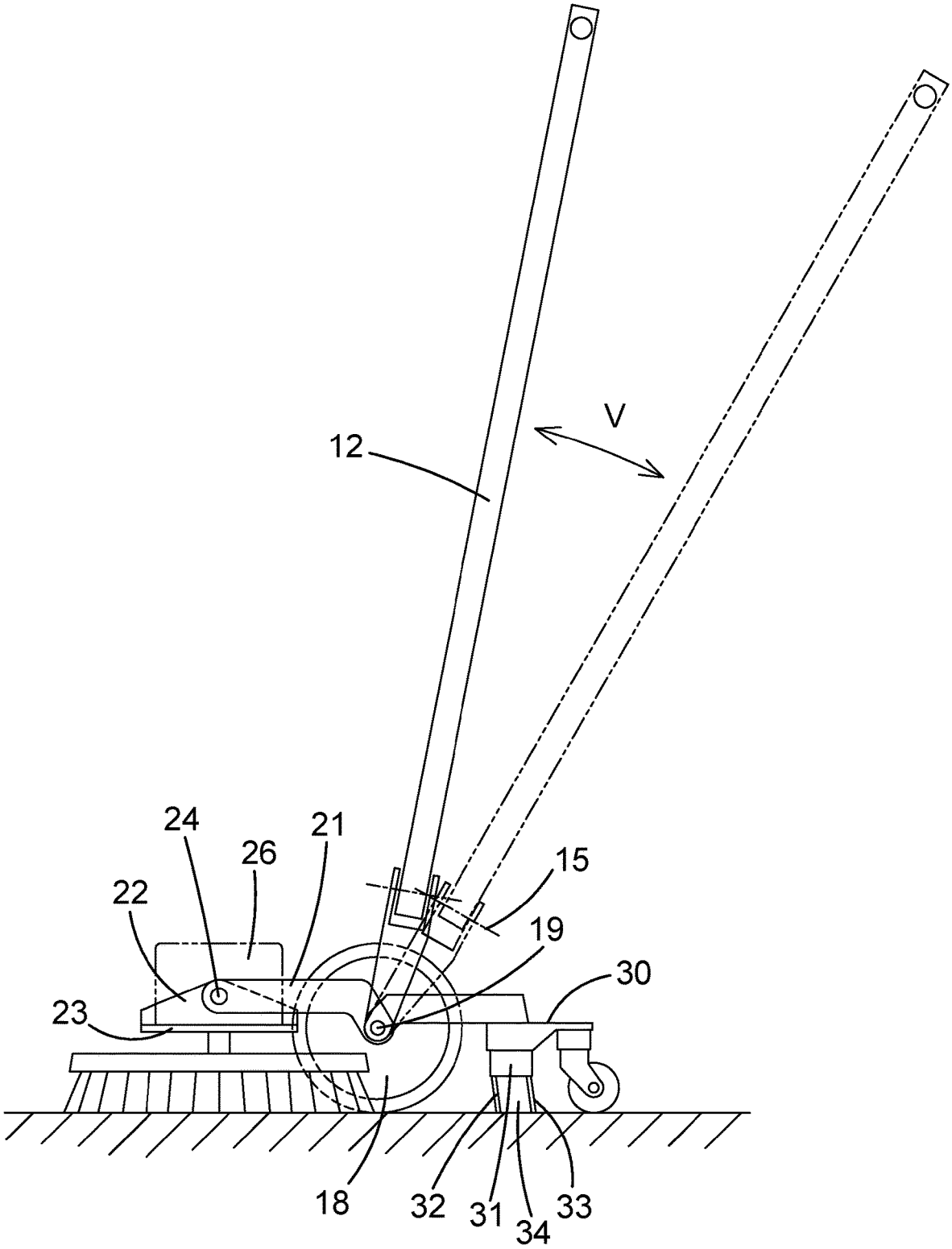
Figure 3:
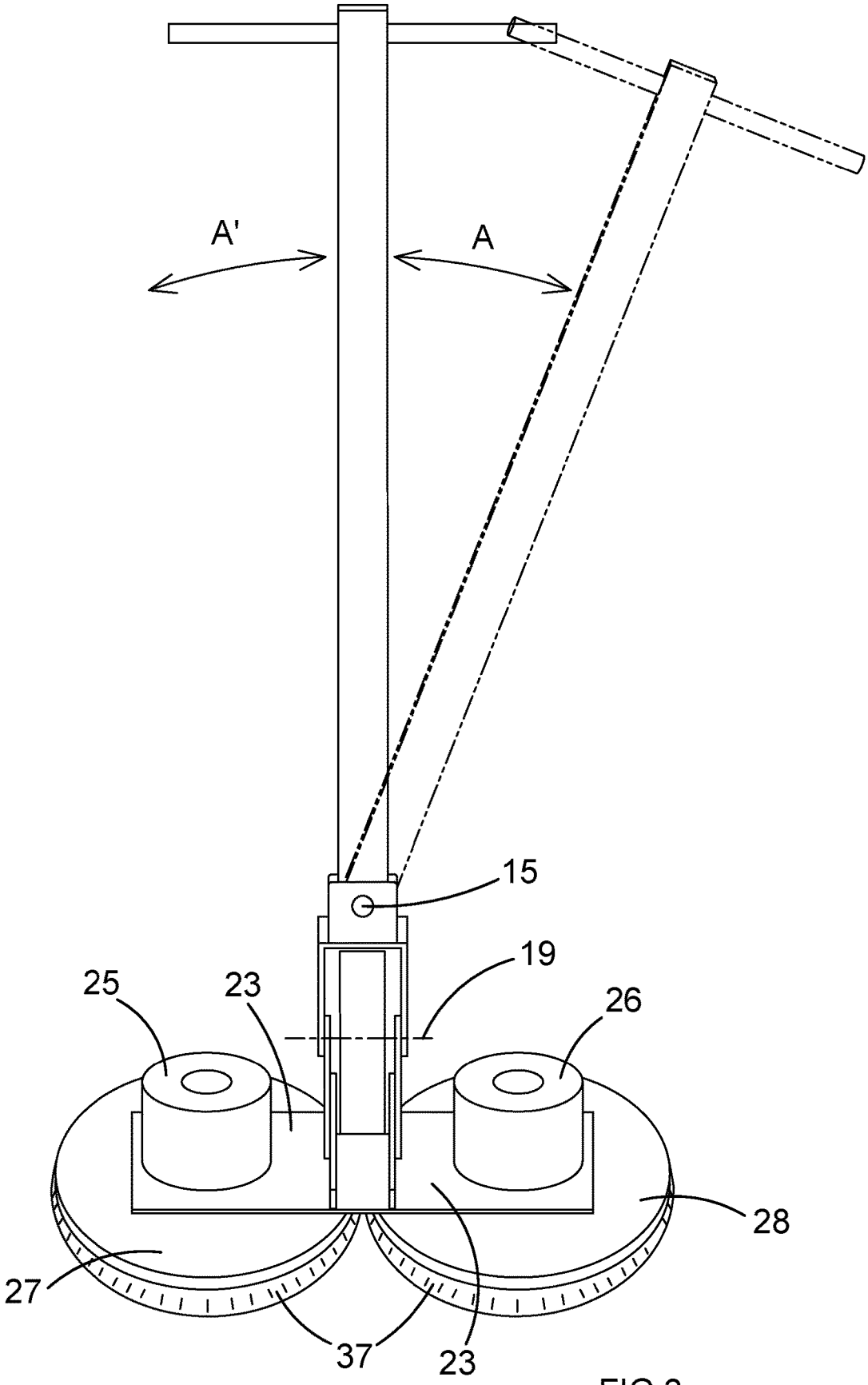
FIG. 3 is a front perspective view of the scrubber-dryer.

As shown in FIG. 2 a pair of elongate, forwardly extending, spaced apart, parallel mounting struts 21 (linkages) are pivotally attached at rear end regions thereof to opposite respective sides the wheel axle 19 projecting from either side of the wheel 18. Front end regions of each strut are attached to a pair of upstanding, spaced apart generally trapezoidal upright brackets 22 formed on a rectangular work base plate 23. The attachment is made via a pivot connection 24 having a transverse axis of pivoting rotation.

The rear end regions of the struts are each formed with a generally semi-circular (convex) hump 43, an edge of which defines an upper convex surface 40. The surface has at front and rear limits thereof steps 41 and 42 (see FIG. 4). A central portion of the surface is formed with a square cut-out (or indent) 44.

Figure 4:
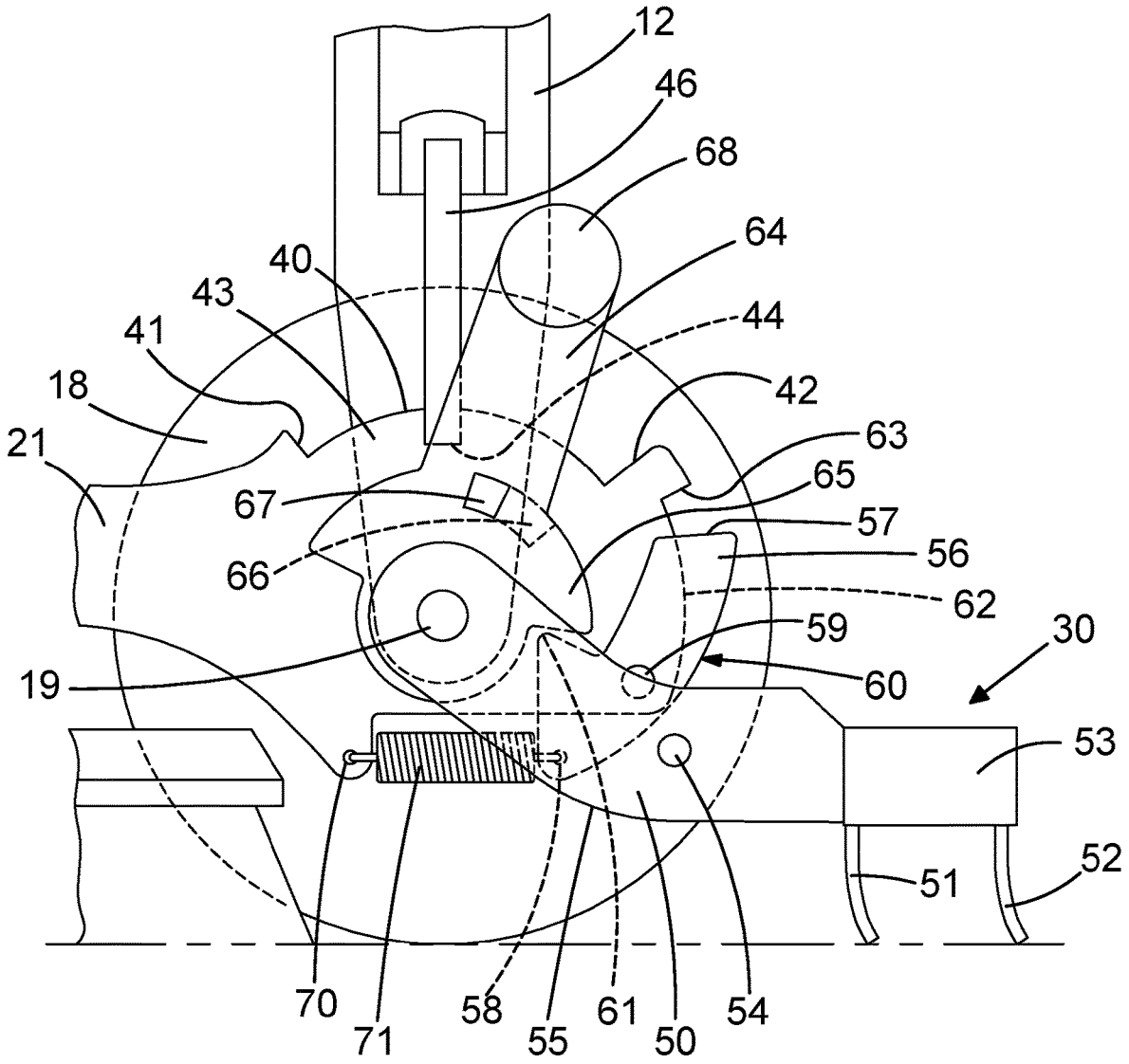
FIG. 4 is a side view, of a lower portion of the machine of the present invention.

Within the bracket 14 and between the ear portions of the bracket is a fork member 45 provided with two spaced apart depending prongs 46 (one visible in FIG. 4). The lower ends of each prong are sized to be a fit for the indents 44 in the strut hump. The terminal face of each prong abuts the upper convex surface of the strut hump, as shown in FIG. 4. The handle is locked against vertical pivoting when the prong sits in the indent. This immobilises or locks the handle in a vertical orientation.

Returning to FIG. 3, the base portion supports thereon two electric motors side by side which are a left scrubber electric motor 25 and a right scrubber electric motor 26. A left work head scrubber brush 27 and a right work head scrubber brush 28 are attached under the base portion 23 to depending respective rotors (not shown) of the electric motors. The left scrubber and right scrubber are mounted to the rotors using conventional means such as a hub or chuck (not shown).

Each scrubber brush 27, 28 comprises a disc shaped base portion 29, and an annular array of fibre brushes 37, fixed an underside of the base portion. The scrubber brushes are arranged to enable rotation in opposite directions and about parallel vertical axes, which can provide forward or rearward propulsion.

Pivotally mounted to the rear of the wheel 18 is a squeegee device 30. Two parallel trailing arms (one visible as 50) are provided, coaxially mounted at a front end thereof to the wheel axle 19. This allows the device to follow surface undulations, but also allows it to be folded up when not in use. The collector 30 comprises an elongate lenticular form squeegee collector arm, of conventional design having a front blade 51, a rear blade 52 and a roof portion 53 The squeegee interior (suction chamber 53) defined between forward and rear blades is in fluid communication (via a roof port, not shown) with a conventional suction drive (not shown) which may be mounted on the handle portion 12 or the base portion 23. This entrains and draws-up waste water from the floor that has passed through the scrubbers' brushes. Waste water drawn-up from the suction chamber is stored in a reservoir (not shown). The suction drive and tank may be positioned above the scrubber base portion, or on the handle portion 12, or at another convenient location on the machine 10.

The trailing arms 50 have a dog leg profile with an elbow 55 region below the pivot 19. A distal end of the trailing arm is attached to the roof portion 53. The attachment may be via a pivot which permits limited rotation of the squeegee device with respect to the trailing arm, the better to follow floor contours. At a mid-portion of the trailing arms there is an inward (transverse) directed cylindrical dog or latching pin 54.

A squeegee latch member 56 is pivotally attached to a rear lower region of the linkage 21 at a pivot 59. The latch member has an upper face 57 and a lower region formed with a bore 58. An outer rear edge 60 of the latching member has a convex profile. A front edge 61 of the latch member is formed with a wedge-shaped profile. The pivot 59 permits the member to see-saw within limits provided by the mechanism with which it engages.

A rear edge 62 of the linkage strut 21 has a convex profile. An upper region of the rear edge is formed with a radially directed step 63.

A latch release lever 64 has a lower region which is attached to the wheel axle 19. The lower region is provided with a rearwardly facing step 65. A cut out arcuate slot 66 is provided in the lever in the region above the pivot. This slot slidably accommodates a block 67 which is fixed outwardly from the linkage 21 and provides a stop to limit rotation of the lever fore and aft around the pivot 19 with respect to the linkage. An upper end region of the lever tapers to a knob 68 which can be foot or hand operated to shift the lever.

A lower region of the linkage 21 is provided with a bore 70. A coiled extension spring 71 is hooked between the bore 70 and bore 58 in the lower end region of the latch member 56. The spring biases the latch member upper region outwards (i.e. rearwards) about the pivot 59.

Figure 5:
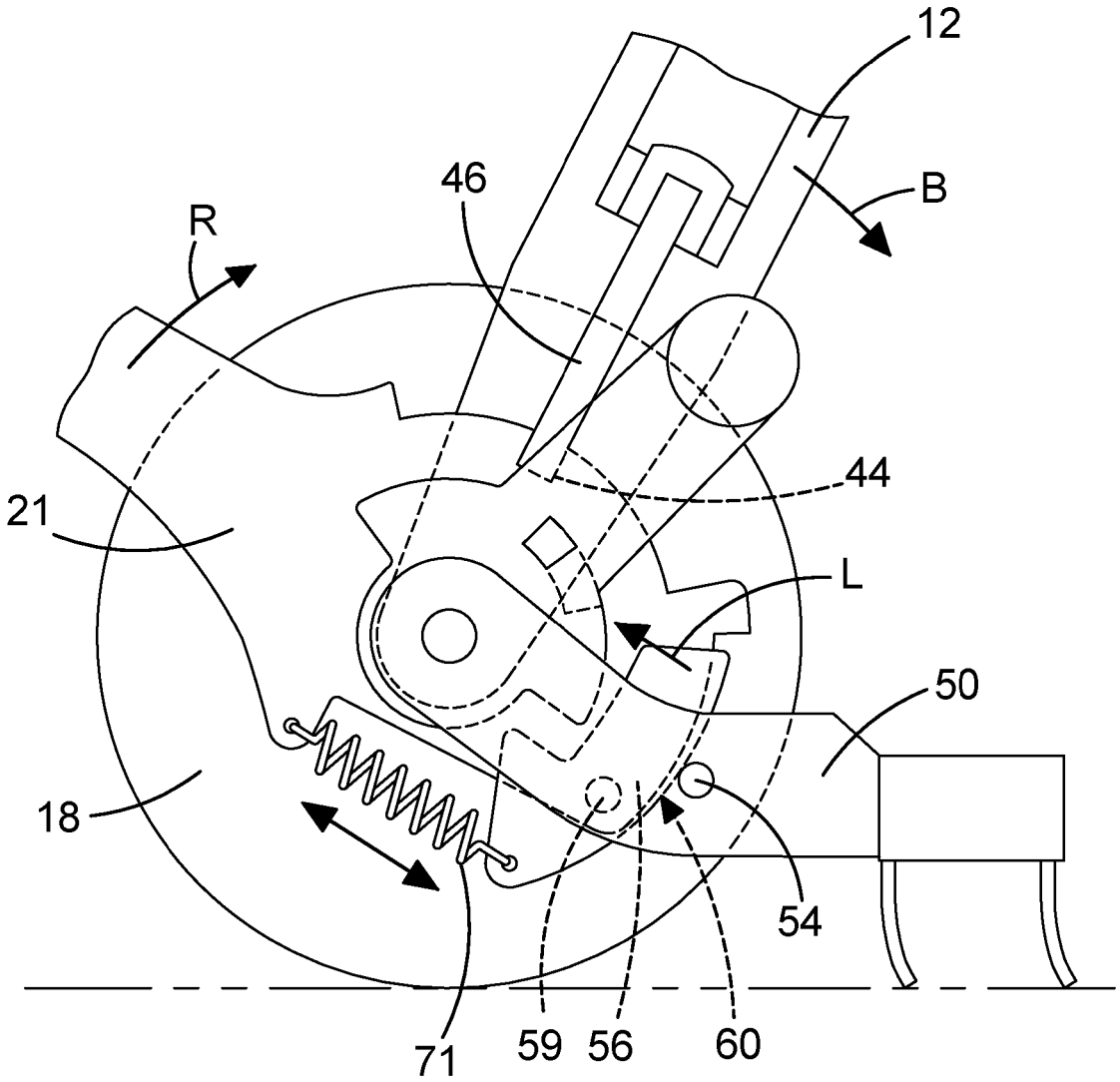
FIG. 5 is a similar side view with the machine tilted back to lift the work head and associated linkage.

The operation of the squeegee latching/unlatching mechanism will be described below. In FIG. 5 the handle 12 is shown tilted back in the direction of the arrow B. Because the lower end of the locking prong 46 is engaged with the indent 44 the tilting of the handle causes the linkage strut 21 to rotate with the handle in the direction of the arrow R, so that the distal end of the linkage arm rises. The wheel 18 rocks with the handle. This tilting of course also causes the work head assembly of brushes 28,29 and base portion 23 to rise up from the floor, away from the working configuration. Concurrently, the latching member 56 is rotated down, with the convex rear edge urged into contact with the latching pin, as the spring 71 is extended. The pin is essentially stationary due to the constraint offered by the squeegee device 30 on the floor surface. The pin causes the latching member upper end to rotate in inwards as shown by the arrow L in FIG. 5.

Figure 6:
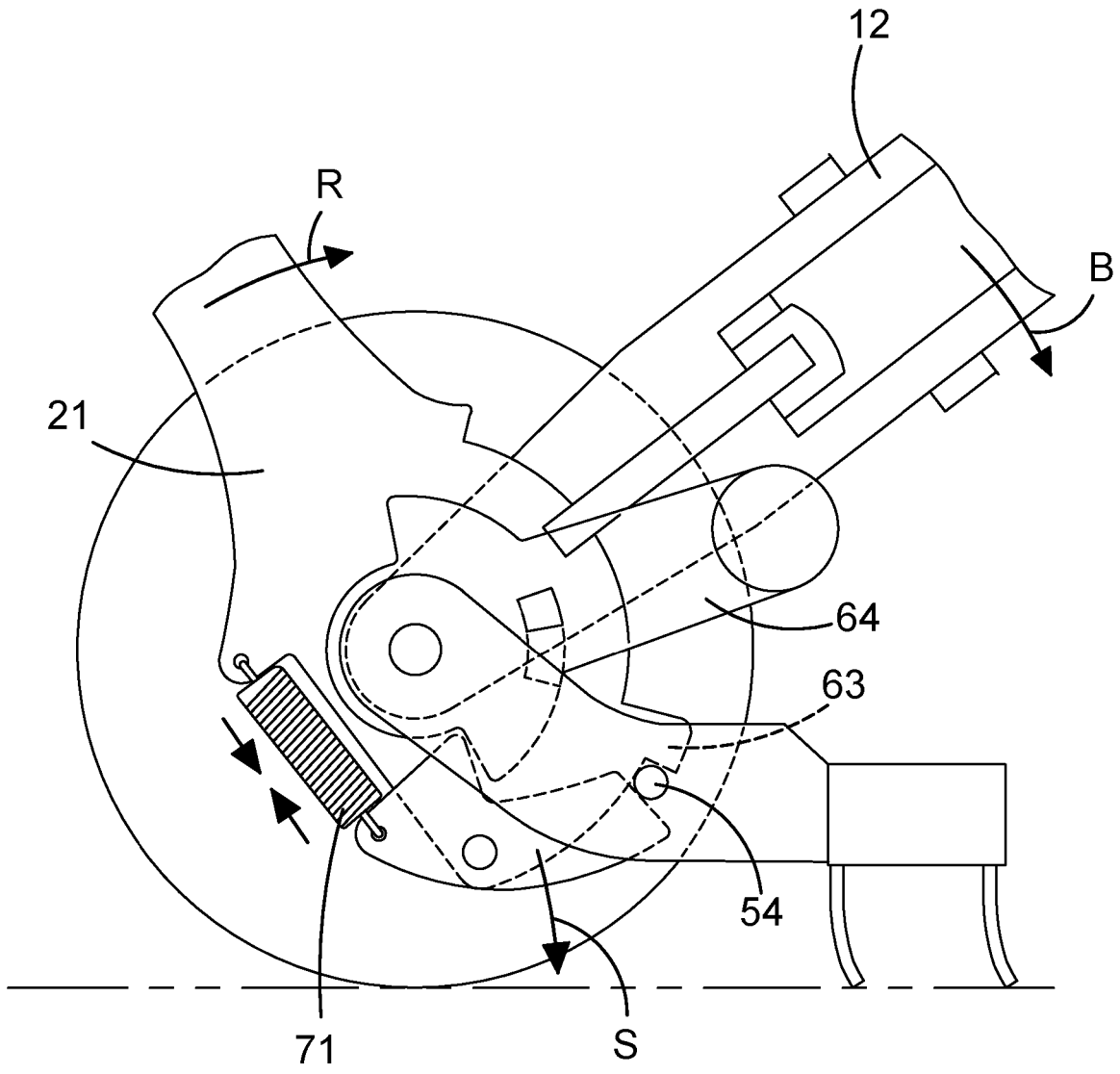
FIG. 6 is a similar view with a squeegee latching mechanism engaged.

Turning now to FIG. 6, as the tilting continues the latching member upper end passes the pin 54 and springs out behind the pin, in the direction of the arrow S shown in FIG. 6, due to contraction of the spring 71. Further tilting is prevented by the step 63 of the linkage strut 21 acting on the pin 54. The upper face 57 of the latch member is now constraining the lower side of the pin, so that the pin is latched between the step 63 and the upper face 57. Together these serve as a latching seat for the pin (dog).

Figure 7:
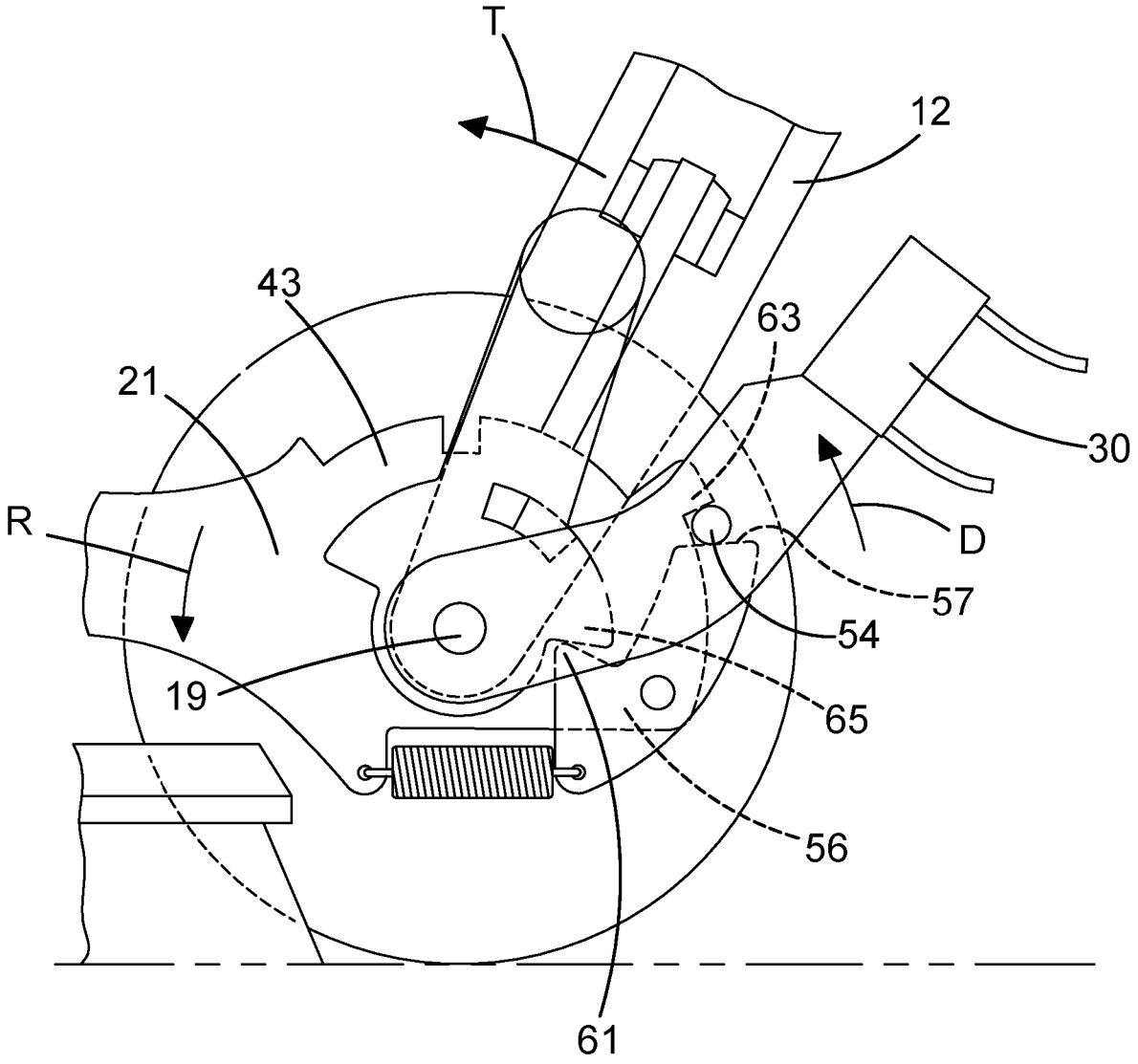
FIG. 7 is a similar view but with the machine tilted back so the work head in on the floor and the squeegee device is lifted off the floor in its latched position.

In FIG. 7 the handle 12 is tilted back towards the vertical in the direction of the arrow T. The linkage strut 21 rotates back down in the arrow direction R. Corresponding rotation of the linkage strut 21 rotates the step 63 and latch member with the linkage strut. The pin 54 is therefore rotated with the latching seat upwards. The trailing arm is thus pivoted upwards about the wheel axle (pivot) 19, which causes the squeegee device 30 to rise therewith, as shown the figure, in the direction of arrow D. The handle may be unlocked from engagement with the linkage strut 21 by retraction of the prong 46 from the indent 44, so that the machine may be utilised with the squeegee device retracted up (e.g. when dry floor brushing/polishing is carried out, and/or wet collection is not necessary).

In this way a simple rearward rotation of the handle automatically latches the squeegee device in a retracted orientation, spaced apart from the floor when the tilt is removed.

The latch release lever may subsequently be used to return the squeegee device to the working, floor contacting configuration, as will be explained now. The lever is manually (or by foot) depressed so as to shift the lever clockwise as shown in FIG. 7. The rearward facing step 65 of the lever lower region rotates towards the front edge 61 of the latch member. As the step 65 rotates down in the arrow direction C (in FIG. 8) it contacts the latching member edge 61.

Figure 8:
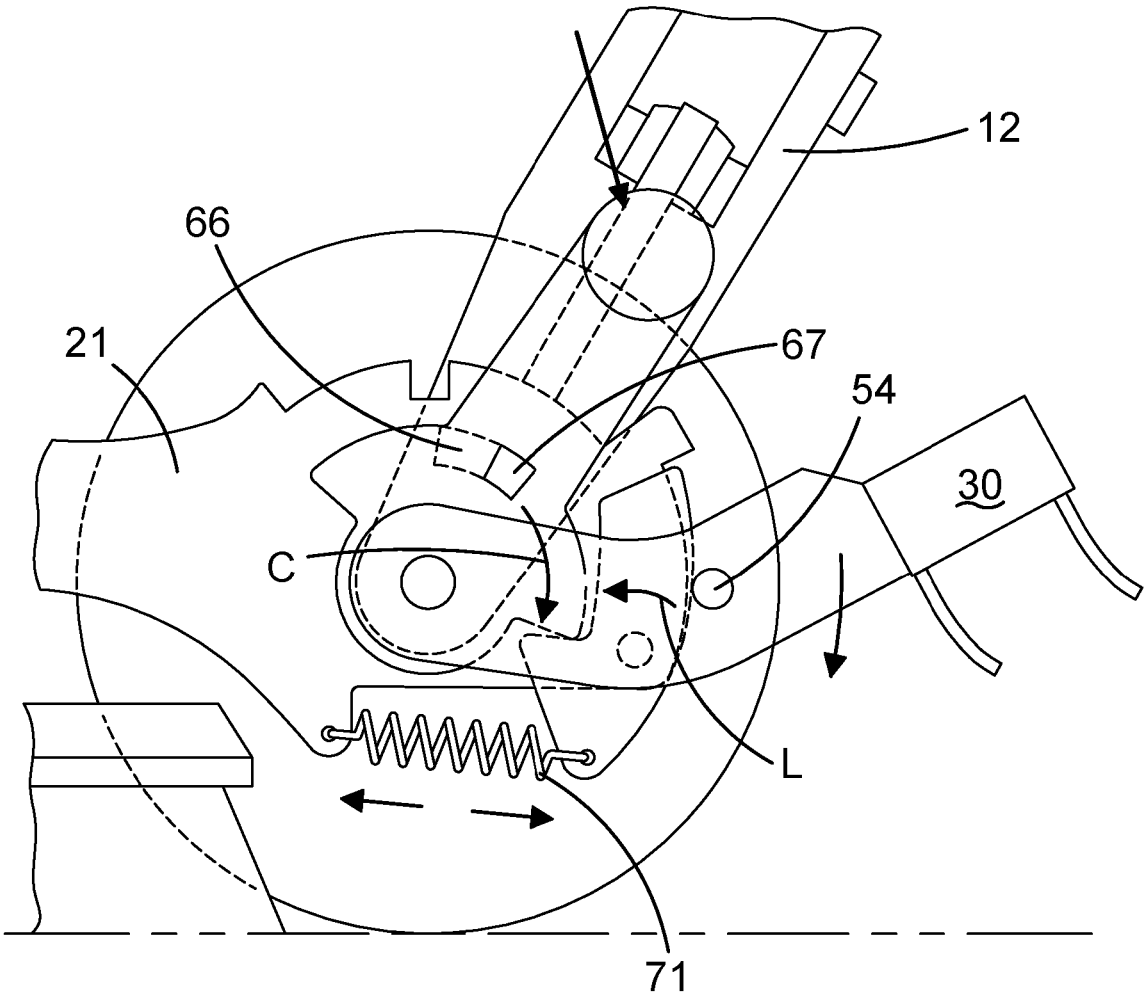
FIG. 8 is a similar view showing the operation of a squeegee release action by which the latch is disengaged.

The camming action between them causes the upper end region of the latching member to retract by shifting inwardly in the direction of the arrow L in FIG. 8, against the outward biasing of the spring 71. The rotation of the lever is limited by travel of the block 67 with respect to the arcuate slot 66. Retraction inward of the latch member upper region releases the constraint offered by the upper edge 57. This releases the pin 54 from the latching seat, so that the trailing arm and squeegee device can rotate back down to the floor surface, aided by the biasing provided by the spring 71 and the contact between the pin 54 and the convex rear edge 60 of the latch member.

Figure 9:
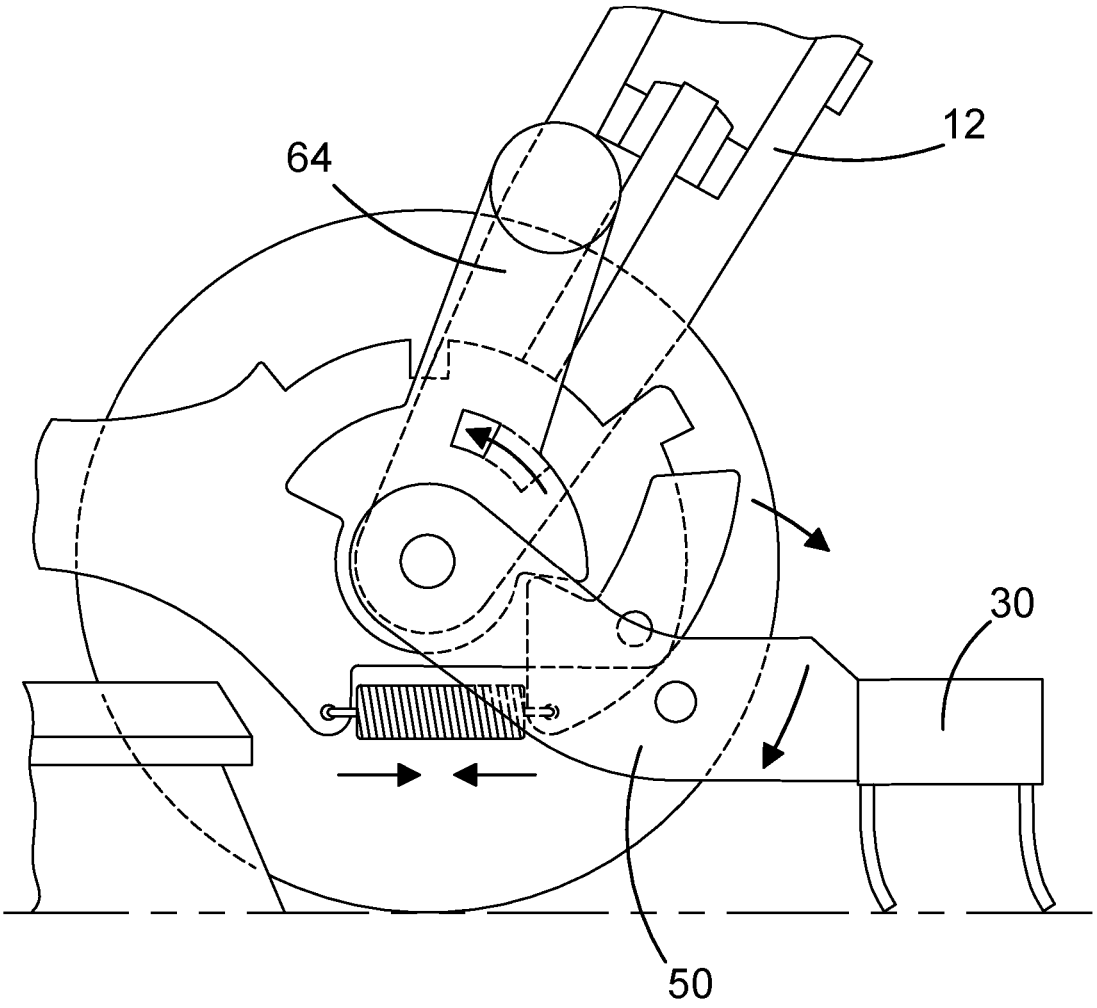
FIG. 9 is a similar view with the squeegee device back on the floor surface with the latch primed for engagement again.

As shown in FIG. 9, when the trailing arm 50 reverts to the working configuration, the latch member is free to return to the latched position, ready for a new lathing cycle, with the lever pivoted back by the return action of the camming surface 61 on step 65, urged by spring 71.

The description above concerns the mechanisms visible on one side of the scrubber machine. Counterparts are present on the other side, so it should be understood in the preferred specific arrangement that there are two linkage struts, two trailing arms, two latch members, and two springs. There will typically be a single squeegee device 30 and handle 12.

Figure 10:
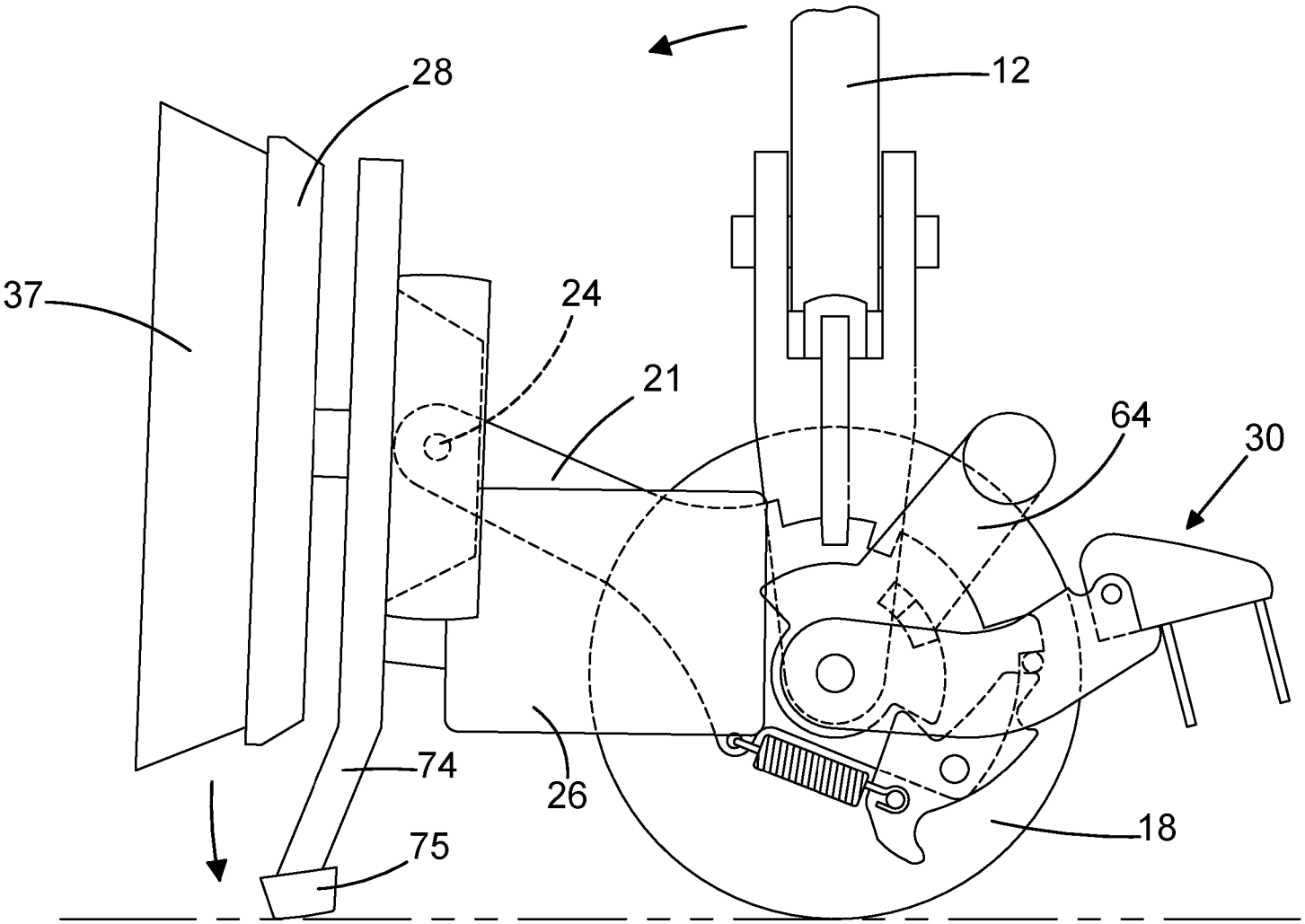
FIG. 10 shows the machine in a storage/maintenance configuration.

The tilting action by which latching occurs also doubles as a means for raising the front end of the machine up, so as to permit maintenance or substitution of work head brushes or treatment tools, as shown in FIG. 10. As such the work head or heads may be provided with wheels, rollers or legs 74 or feet 75, which can be used to hold and support the work head(s) in a lifted orientation. The work heads may be rotated clockwise by about 90 degrees to form a stable maintenance/transport or storage configuration.

In the foregoing description and the associated drawings we have not shown features which will typically be present, but which are not essential to the core aspects of the invention. These include a cleaning liquid reservoir and dispenser, a suction drive for the squeegee collector, or a dirty water reservoir fed by the squeegee collector. These are well known to the person skilled in the art so are not described in detail herein. For polishing machines or burnishing machines and the like no such ancillary features may be necessary.

The invention claimed is:

1. A walk-behind floor treatment machine comprising:

a base portion provided with and supported by at least one rotatable work head for treating the floor, a handle portion for steering or guiding the machine along a working direction of travel and adapted to be pivotable with respect to the base portion, drive means for rotating the work head with respect to the base portion, floor-engaging wheel means for supporting the handle portion, the wheel means having a substantially transverse axis of rotation with respect to the working direction so as to permit machine travel in the working direction, the wheel means being coupled to the base portion by a linkage which permits vertical travel of the base portion and the at least one rotatable work head with respect to the wheel means, which provides transverse constraint to limit or prevent yawing of the base portion with respect to the wheel means, wherein a lower region of the handle portion is pivotably connected to the wheel means so that the handle portion may pivot through a generally vertical arc, and wherein a handle pivot lock mechanism is provided in which the adoption of a predetermined handle portion orientation permits one or more locking features to act on one or more corresponding constraint features so as to prevent pivoting movement of the handle portion with respect to the linkage in at least one axis, whereby tilting back of the handle portion when the handle portion is locked causes a corresponding rise of the linkage and base portion with the at least one rotatable work head so as to lift them from a floor surface over which the machine travels.

2. The machine as claimed in claim 1 wherein the predetermined handle orientation required by the handle pivot lock mechanism is a generally vertical orientation.

3. The machine as claimed in claim 1 wherein in the predetermined handle orientation the locking feature becomes aligned with the one or more constraint features so as to permit mutual engagement, and when the orientation is not achieved misalignment prevents engagement of the features.

4. The machine as claimed in claim 1 wherein the locking feature or features are one or more detent features and the constraint feature or features are one or more indent features, one of said features being associated with the base portion or linkage and the other of said features being associated with the handle portion.

5. The machine as claimed in claim 4 wherein the linkage comprises at least one strut, one end region of which is provided with a pitch pivotal connection to the wheel means, which connection is coaxial with the wheel means axis of rotation, and wherein another end region of the at least one strut is attached to the base portion.

6. The machine as claimed in claim 5 wherein the at least one strut is provided with a convex upper surface provided with the one or more indent features, and the one or more detent features is connected to a lower region of the handle portion for travel in an arc which corresponds to the profile of the convex upper surface, the arrangement being such that the detent feature can slide over the convex surface during up/down pivoting of the handle portion about the transverse axis.

7. The machine as claimed in claim 6 wherein a lock actuator urges the detent feature against the surface so when the detent feature and indent feature are aligned the detent feature projects into the indent so as to lock motion of the handle portion.

8. The machine as claimed in claim 1 wherein the wheel means comprises at least one of a wheel, roller or ball, disposed at a lower region of the handle portion.

9. The machine as claimed in claim 1 wherein the wheel means has a fixed transverse axis of rotation.

10. The machine as claimed in claim 1, wherein a squeegee suction device is provided for collecting and entraining liquid lifted from the floor surface over which the machine travels, the squeegee suction device being attached to the wheel means via one or more trailing arms which is attached at one end region to the squeegee suction device and at an opposite end region is pivotably attached to the wheel means for pivoting co-axially about the said transverse axis of rotation of the wheel means, the arrangement being such that the one or more trailing arms and squeegee suction device may pivot up or down about the transverse axis as they trail behind the treatment machine.

11. The machine as claimed in claim 10, wherein a squeegee latch mechanism is provided which is configured to latch the trailing arm in a fixed rotational position with respect to the linkage between the base portion and the wheel means, which rotational position corresponds to a lifted squeegee orientation in which the squeegee suction device is spaced apart from the floor.

12. The machine as claimed in claim 11 wherein the fixed rotational position adopted by the latched squeegee suction device corresponds to the locked handle being tilted to at least an amount at which the at least one rotatable work head is lifted clear of the floor surface.

13. The machine as claimed in claim 12 wherein the work head is pivotally attached to the linkage, and the clearance for the work head in the tilted orientation is sufficient to allow the work head to rotate freely from a working orientation to a maintenance or storage orientation in which the underside of the work head is facing generally outwards.

14. The machine as claimed in claim 13 wherein the work head is provided with one or more legs or wheels or rollers for supporting the work head the maintenance or storage orientation.

15. The machine as claimed in claim 11 wherein there are two transversely spaced apart: trailing arms, latching members, trailing arm dogs, release levers, and linkages between the wheel means and base portion.

16. The machine as claimed in claim 15 wherein each trailing arm is pivotally attached to the squeegee suction device so that the squeegee suction device is capable of pivoting with respect to the trailing arm about a substantially transverse axis of rotation of the squeegee suction device.

17. The machine as claimed in claim 11 wherein the latching of the squeegee suction device involves the engagement of a dog with a corresponding constraint feature.

18. The machine as claimed in claim 17 wherein the dog is provided on the one or more trailing arms, and the constraint feature is provided by a latching member associated with the linkage.

19. The machine as claimed in claim 18 wherein latching takes place when the locked handle portion is tilted down sufficiently to cause the one or more trailing arms to approach the latching member so that the dog engages with a seat which includes the constraint feature.

20. The machine as claimed in claim 18 wherein a squeegee release lever is provided which is adapted to act upon the latching member to release the engagement between the latching member and the dog.

21. The machine as claimed in claim 20 wherein the squeegee release lever comprises an upper free end region which may be foot or hand operated and a lower region which is attached for coaxial pivoting about the transverse axis of rotation of the wheel means.

22. The machine as claimed in claim 21 wherein the lower end region of the release lever is configured with a rising camming surface which acts upon the latching member to disengage the constraint feature and the dog when the lever is depressed, the squeegee suction device thereafter reverting to a working configuration on the floor surface.

23. The machine as claimed in claim 18 wherein the latching member is pivotally fixed to a rear end region of the linkage.

24. The machine as claimed in claim 18 wherein the latching member is spring biased so as to urge the latching member into an engagement disposition in which the dog abuts the constraint feature when sufficient relative motion of the dog and latching member has taken place during tilting.

* * * * *